United States Patent [19]

Moog et al.

[11] 4,108,041

[45] Aug. 22, 1978

[54] PHASE SHIFTING SOUND EFFECTS CIRCUIT

[75] Inventors: Robert A. Moog, East Aurora, N.Y.; Roger Flavius Cox, Northbrook, Ill.

[73] Assignee: Norlin Music, Inc., Lincolnwood, Ill.

[21] Appl. No.: 700,250

[22] Filed: Jun. 25, 1976

[51] Int. Cl.[2] ..... G10H 1/02

[52] U.S. Cl. ..... 84/1.24

[58] Field of Search ..... 84/1.01, 1.24, 1.25, 84/1.27; 179/1 J

[56] References Cited

U.S. PATENT DOCUMENTS

| | | | |
|---|---|---|---|
| 3,007,361 | 11/1961 | Wayne, Jr. | 84/1.01 |
| 3,609,205 | 9/1971 | Schwartz | 84/1.25 |
| 3,644,657 | 2/1972 | Miller | 84/1.25 |
| 3,737,555 | 6/1973 | Mathias | 84/1.25 |
| 3,749,837 | 7/1973 | Doughtt | 84/1.01 X |
| 3,795,756 | 3/1974 | Suzuri | 84/1.22 |
| 3,833,752 | 9/1974 | Vanderkooh | 84/1.24 |
| 3,866,505 | 2/1975 | Adachi | 84/1.24 |
| 3,979,991 | 9/1976 | Kawamoto | 84/1.25 |
| 4,000,676 | 1/1977 | Love | 84/1.25 |

*Primary Examiner*—Gene Z. Rubinson
*Assistant Examiner*—Vit W. Miska
*Attorney, Agent, or Firm*—Ronald J. Kransdorf

[57] ABSTRACT

A sound effect circuit with a phase shifter producing a signal shifted in phase with respect to an input signal, a combining circuit for arithmetically combining the input and phase shifted signals to produce an output signal, an oscillator for periodically modulating a characteristic frequency of the phase shifter and a modulation control circuit. The modulation control circuit causes the modulation rate to gradually increase when modulation is manually switched on and to gradually decrease when modulation is switched off. The modulation control also causes the characteristic frequency to vary inversely with the modulation rate. The system defined by a part of the circuit producing a first output signal proportional to the sum of the input and phase shifted signals has a comb shaped frequency response curve and a part of the circuit producing a second output signal proportional to the difference between the input and phase shifted signals has a comb shaped frequency response curve inversely related to that of the summing part of the circuit. When the two output signals are fed to separate speakers, the total frequency response curve of the two systems taken together is substantially flat, but the distribution of energy in the frequency spectrum moves in space as the modulation proceeds to produce a new "stereo phase shift" sound effect. A rotary potentiometer for mixing the first and second outputs signals with each of the input signal and the phase shifted signal in selected proportion provides a third output signal with selectively variable characteristics.

30 Claims, 3 Drawing Figures

FREQUENCY RESPONSE INPUT-TO-MAIN OUTPUT

FREQUENCY RESPONSE INPUT-TO-AUX OUTPUT

PHASE SHIFTING SOUND EFFECTS CIRCUIT

BACKGROUND OF THE INVENTION

This invention relates to a special sound effects circuit for use with an electrical musical instrument and, more particularly, to such a circuit in which the sound effects are achieved by controlling both the rate of phase shift modulation and the average amount of phase shift imparted to an input signal.

Numerous circuits are known which operate on an input audio signal from a musical instrument to produce different sound effects pleasing to the ear. In particular, a number of circuits are designed to simulate at least some of the low rate frequency modulation and amplitude modulation effects developed by a mechanical system such as that disclosed in U.S. Pat. No. Re. 23,323 issued to D. J. Leslie in which a speaker is rotated about a vertical axis at a rate on the order of 1 to 15 revolutions per second.

Some such circuits are shown in U.S. Pat. No. 3,644,657 issued Feb. 22, 1972, to Francis A. Miller. In FIG. 10 of this patent, an input signal is phase shifted by a network producing at least 720° of phase shift and the input signal and phase shifted signal are then summed together to produce an output signal which when converted to sound has some of the sound characteristics of a rotary speaker system.

A circuit is shown in FIG. 7 of this patent which is apparently designed to enable an operator to simulate the starting and stopping characteristics of a rotating speaker. The magnitude of a control signal which establishes the modulation rate may be selectively varied by manually operable controls at or near the musical instrument to increase and decrease the modulation rate to respectively simulate the sound effects produced as the rotary speaker velocity is increased and decreased. However, the rate of change of the modulation rate is apparently not preselected and thus requires more than a simple on-off operation by the user. Further, the frequency response of the phase shifting network remains unaffected by the control signal such that, unlike a rotary speaker system, a flat response curve to the mid-range of the audio frequency spectrum at the lower modulation rates is not achieved.

SUMMARY OF THE INVENTION

A principal object of the present invention is to provide a sound effect circuit in which an instantaneous characteristic frequency of a phase shifting network is modulated at a controlled rate which gradually increases and decreases over preselected time periods in response to actuation of a control switch while an average characteristic frequency thereof is automatically gradually decreased and increased, respectively, at a preselected rate. Preselection of the rate of increase and decrease of modulation frequencies between two terminal frequencies simplifies operation of the unit by the user and enables the user to concentrate on other musical operations. In addition, the simulation of rotary speaker speed-up and slow-down is identically reproducible without the need for operator unit beyond the mere closure and opening of a switch. Increasing and decreasing the characteristic frequency of the phase shifting network in proportion to decreases and increases of the modulation rate more closely simulates the sound effect achieved by a rotating speaker as it changes its velocity gradually, rather than abruptly, due to its inertia.

An advantageous feature of the invention in keeping with this objective is the provision of a single control signal which both controls the modulation rate and the average characteristic frequency of the phase shifting network. In the illustrating embodiment, the phase shifted signal is combined with the input signal which results in a comb shaped frequency response curve. The gradual increase of the characteristic frequency of the phase shifting network as the modulation rate is gradually decreased results in the "comb" moving up the frequency spectrum such that the response curve is relatively flat up to frequencies in excess of 6 kHz when the modulation rate is at its lowest value.

A further object of the present invention is to provide a special effects circuit in which a modulated phase shifted signal is combined with the input signal from which it is developed to produce an output signal in such a fashion that a comb shaped frequency response curve results which is characterized by sharp peaks separated by larger bandwidth low response portions of the curve.

Still another object of the present invention is to provide a special effects circuit in which an audio input signal is combined with a phase shifted signal to develop a first output signal having a first comb shaped frequency response curve and is combined in an opposite sense with the phase shifted signal to develop a second output signal having another comb shaped frequency response curve which is inversely related to the first comb shaped response curve and in which each output signal is applied to a separate speaker to achieve a unique sound effect. The frequency response associated with the two outputs taken together at any given time is substantially flat, but the distribution of the sound energy in the frequency spectrum moves in space during modulation.

Yet a further object of the present invention is to provide means for mixing in selected proportions the first and second output signals with the input and phase shifted signals to develop yet a third output signal having characteristics which may be selectively altered by means of a manually operable control.

The foregoing objects, features, and advantages will be discussed in more detail and further features and advantages will become apparent in the following detailed description of the preferred embodiment.

BRIEF DESCRIPTION OF THE DRAWING

The following description of the preferred embodiment will be given with reference to the several views of the drawing in which.

DESCRIPTION OF THE PREFERRED EMBODIMENT

Figure 1:
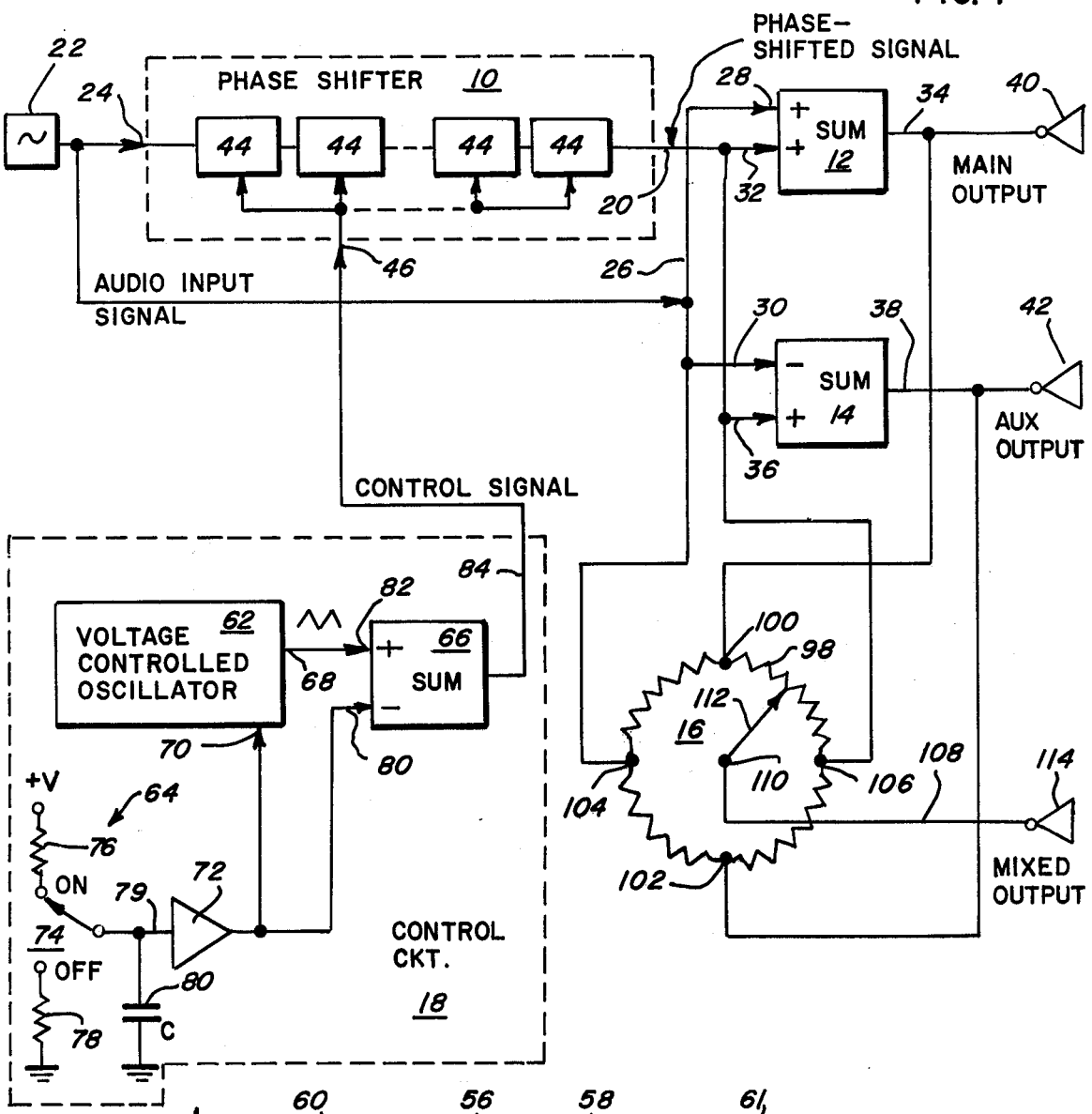
FIG. 1 is a schematic, partially in functional block form, of an illustrative embodiment of the special effects circuit constructed in accordance with the present invention.

Referring to FIG. 1 of the drawing, one illustrative embodiment of the special effects circuit of the present invention is seen to include a phase shifting network or phase shifter 10, a first fixed combining circuit 12, a second fixed combining circuit 14, a selectively variable combining or mixing circuit 16, and a control circuit 18. The phase shifter 10 produces a signal on an output 20 thereof which is shifted in phase with respect to an audio frequency input signal from an audio signal source 22. Signal source 22 can comprise any source of audio frequency signals, but it is intended that the special effects circuit will be often used in conjunction with an electrical musical instrument, such as an electric guitar, in which case signal source 22 is that instrument or an amplifier circuit which produces amplified signals proportional to those developed by the instrument.

The audio input signal from source 22 is applied to an input 24 of phase shifter 10 and also to a buss line 26 associated with the combining circuits 12, 14, and 16. The audio input signal from buss 26 is applied to a normal input 28 of combining circuit 12 and to an inverting input 30 of combining circuit 14. Combining circuit 12 sums the audio input signal with the phase shifted signal which is applied to a normal input 32 thereof to produce a first or main output signal on an output 34. Combining circuit 14, likewise, combines the audio input signal with the phase shifted signal which is applied to a normal input 36 thereof to develop a second or auxiliary output signal on an output 38 thereof. The main and auxiliary output signals are amplified as needed and respectively converted to sound by speakers 40 and 42 to produce the musical effect.

Each of the phase shifter 10, the combining circuit 12 and the combining circuit 14 can comprise any one of a large number of conventional circuits. The present invention does not reside in the details of any such conventional circuit. Accordingly, only a functional description, rather than a detailed circuit description, of each of these elements is provided. All that is required for successful operation is that the specific circuitry chosen for each of these elements function in the manner specified.

The phase shifter 10 preferably comprises a plurality of substantially identical phase shifting sections 44 connected in cascade and each causing a maximum phase shift of 180° C. It should of course be understood that two ninety degree phase shifting sections could be used in place of each 180° phase shifting section, if desired. In order to obtain a frequency response curve such as shown in either of FIGS. 2*a* or 2*b* having three dips or peaks, a maximum phase shifting capability of 1080° is required. If each shifting section 44 is capable of producing 180° phase shift, then six such sections are required. The actual number of phase shifting sections used is, of course, dependent upon the frequency response curve that is desired. Briefly, the 180° phase shifting sections are required for each narrow band dip or peak in the response curve.

Each phase shifting section 44 has a characteristic frequency below which little or no phase shift is realized and above which the amount of phase shift imparted to the input signal increases with the frequency of the input signal up to the maximum phase shift capability of the section. Each phase shifting section 44 has a control input 46 connected in common to phase shifter 10. The value of the characteristic frequency is dependent on and varies proportionately with the magnitude of a control signal applied to a control input 46 common to each of the sections. As will be explained, the control circuit 18 functions to generate a control signal having both a DC component and an alternating component which is applied to control input 46 to achieve the desired musical effect.

A variety of conventional circuits may be used to perform the respective functions of combining circuits 12 and 14. For instance, a resistive summing circuit or summing amplifier circuit may be used to perform the function of combining circuit 12. The auxiliary output signal produced by combining circuit 14 is directly proportional to the arithmetic difference between the audio input signal applied to inverting input 30 and the phase shifted signal applied to input 36. As with the combining 12, combining circuit 14 can be constructed from a conventional resistive summing circuit with an inverting input, a differential amplifier, or other like circuit.

Figure 2A:
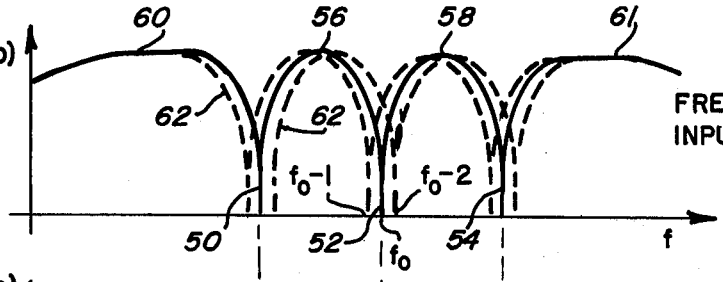
FIG. 2*a* is a representative graph of the type of comb shaped frequency response of the portion of the special effect circuit of FIG. 1 which produces the main output signal.
Figure 2B:
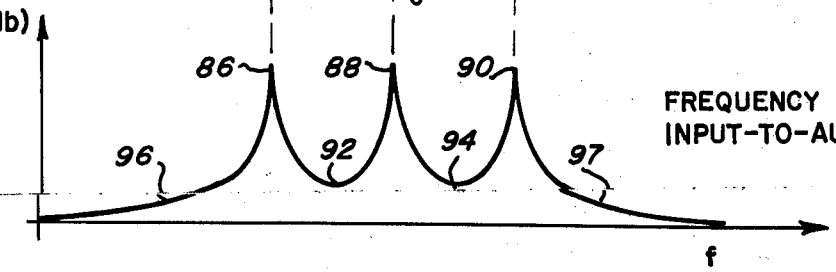
FIG. 2*b* is a representative graph of the frequency response of that portion of the circuit of FIG. 1 which develops the auxiliary output signal, illustrating the inverse relationship to the responsive curve of FIG. 2A.

Referring to FIG. 2*a*, an illustrative frequency responsive curve for the system defined by combining circuit 12 and phase shifter 10 is seen to be comb shaped and is characterized by three dips or nulls 50, 52, and 54 and two peaks 56 and 58 interposed between dips 50 and 52 and 52 and 54, respectively. Peak response portions of the curve 60 and 61 also occur at the low and high ends of the frequency spectrum. The dips 50–54 occur at those frequencies where the phase shifted signal is out of phase from the audio input signal by an odd integer multiple of 180° and the two signal cancel one another. In the illustrative example of FIG. 2*a* the dips 50, 52, and 54 occur at those frequencies where the total phase shift is 180°, 540°, and 900°, respectively. In a phase shifter having six identical 180° C phase shifting sections, the first dip 50 of course occurs at the frequency at which each of the sections introduces a 30° shift. Likewise, the second dip 52 and third dip 54 occur at the frequencies at which each section introduces 90° and 150° of phase shift, respectively. The peaks of course occur at those frequencies at which the phase shifted signal and audio input signal are in phase or out of phase by an even integer multiple of 180° and cancellation is minimum. As the characteristic frequency of each of the sections decreases, the comb response curve moves down the frequency spectrum and vice versa.

In keeping with an important aspect of the present invention, the control signal has two components: an average DC component and an alternating component. The DC component establishes an average characteristic frequency for phase shifter 10 and thus establishes the average position of the comb shaped response curve with respect to the frequency spectrum. The alternating signal is a modulation signal that causes the instantaneous characteristic frequency to alternate above and below the average characteristic frequency. The rate of modulation is established by the frequency of the alternating component of the control signal. Referring to FIG. 2*a*, the modulation of the characteristic frequency causes the comb frequency response to shift up and down the frequency spectrum, such that the frequency at which dips 50, 52, and 54 occur periodically shift back and forth as indicated by the response curve 62 drawn in broken line. For example, if $f_0$ is the average frequency of dip 52, during modulation the frequency of dip 52 will alternate between $f_0$-1 and $f_0$-2.

The control circuit 18 includes a voltage controlled oscillator 62, a manually operable, controlling circuit 64 and a summing or sum circuit 66. The voltage controlled oscillator 62 generates an alternating modulation signal on an output 68 thereof at a frequency which is dependent upon the magnitude of a rate control signal applied to an input 70. The modulation signal preferably has a smooth, symetrical, sawtooth wave form without discontinuities to achieve optimum sound qualities.

The rate control signal applied to input 70 is taken from the output of an amplifier 72 of circuit 64, and its magnitude is dependent upon the manual operation of a double-pole, single-throw, on-off switch 74. An ON pole of switch 74 is connected through a first timing resistor 76 to a positive DC voltage supply +V and an OFF pole is connected to ground through a second timing resistor 78. The common terminal of switch 74 is connected to an input 79 of amplifier 72 which, in turn, is coupled to ground through a timing capacitor 80. The on-off switch 74 is located on or near the musical instrument and is adapted to be easily changed from its ON position to its OFF position. The on-off switch 74 may comprise a foot operated switch commonly known as a "stomp" switch.

In accordance with the invention the rate control signal functions to establish both the modulation rate and the average characteristic frequency to phase shifter 10. The output of amplifier 72, in addition to being coupled to the input 70 of voltage controlled oscillator 62 to establish the modulation rate, is also coupled to an inverting input 80 of a differential type summing or sum circuit 66 which is substantially indentical to combining circuit 14. The summing circuit 66 produces the control signal on its output 84 which is directly proportional to the difference in magnitude between the modulation signal applied to its input 82 from voltage controlled oscillator 62 and the rate control signal. Consequently, the magnitude of the rate control signal establishes the average characteristic frequency of phase shifter 10 and the rate of modulation. The amplitude of the modulation signal establishes the percent of modulation which preferably varies directly with the rate.

With the stomp switch 74 in its off position and capacitor 80 in a discharged state, the rate control signal is at its minimum level. This causes the voltage controlled oscillator 62 to oscillate at its minimum frequency which is selected to be so low that the resultant sound modulation is not noticeable. A frequency of 0.1 Hz has been found to be a sufficiently low frequency. The minimum level of the rate control signal also causes phase shifter 10 to assume its maximum characteristic frequency. This characteristic frequency is preferably selected such that the first dip 50 occurs at an average frequency of more than 6 kHz which is generally beyond the highest frequency note of most musical instruments. With a frequency interval between dips being on the order of 2.5 octaves, the average frequency $f_0$ of the second dip occurs at a frequency which is beyond the range of normal human hearing. Consequently, with the circuit in this condition the phase shifter has practically no detectable effect upon the input signal.

When the on-off switch 74 is switched to its ON position, capacitor 80 is changed from positive DC voltage supply +V through resistor 76. As capacitor 80 gradually charges, the magnitude of the rate control signal exponentially rises over a preselected time period until capacitor 80 is fully charged. The frequency of voltage controlled oscillator 62 increases with the rise of the rate control signal and the modulation rate is gradually increased accordingly. Simultaneously, the summing circuit 66 responds to the increase of the rate control signal by gradually increasing the magnitude of the DC component of the control signal. This causes the characteristic frequency of phase shifter 10 to gradually decrease to its minimum value.

The time period required for the modulation rate to increase from its minimum to its maximum value and for the characteristic frequency to decrease from its maximum to its minimum value is dependent upon the RC time constant of resitor 76 and capacitor 80. A preselected, turn-on time period on the order of ½ second has been found suitable. However, it should be appreciated that other preselected time periods could be achieved by merely changing the values of resistor 76 and capacitor 80, as desired.

When the on-off switch 74 is switched to its OFF position, the capacitor 80 is exponentially discharged through resistor 78 at another rate dependent upon the RC time constant of resistor 78 and capacitor 80. As a consequence, the frequency of the modulation signal is caused to slowly decrease to its minimum value while the characteristic frequency of the phase shifter is caused to gradually increase to its maximum value. While again, other preselected time periods could be used, a preselected turn-off time period on the order of 2 to 4 seconds has been suitable for achieving a pleasing musical effect. The values of resistor 78 and capacitor 89 are chosen accordingly. Thus, it is seen that the control circuit 18 achieves the objective of causing the average characteristic frequency to vary unidirectionally and inversely with the rate of modulation to enhance simulation of the dynamic starting and stopping characteristics of a rotating speaker system.

The provision of combining circuit 14 for providing an auxiliary output signal which is proportional to the difference between the phase shifted signal and the audio input signal achieves another objective of the present invention. Referring to FIG. *2b*, the frequency response curve of the system defined by summing circuit 14 and phase shifter 10 is seen to be comb shaped and to be inversely related to the comb shaped response curve of FIG. *2a*. Peak response levels 86, 88, and 90 occur at the same frequency as dips 50, 52 and 54 occur in the response curve of FIG. *2a*, respectively. Likewise, minimum response levels or dips 92 and 94 occur at the same frequencies at which peak response levels 56 and 58 of the response curve of FIG. *2a*. Similarly, minimal response levels 96 and 99 occuring at the opposite extremities of the response curve of FIG. *2b* correspond to the maximum response levels 60 and 61 at the extremities of the response curve of FIG. *2a*.

The auxiliary output signal provides a unique musical effect by itself. In addition, when the main output signal is applied to the speaker 40 and the auxiliary output signal is applied to the other speaker 42 as shown, the total frequency response of sound energy to input signal of the two systems taken together at any instance in time is substantially level or flat, but the distribution of the energy in the frequency spectrum moves in space as the modulation proceeds. This produces yet another novel stereo phase shift sound effect.

A further advantageous feature of the invention is the provision of variable combining circuit 16 to provide a third output signal which comprise a selected mix of each of the main and auxiliary output signals with the input signal and the phase shifted signal. As seen in FIG. 1, combining circuit 16 comprises a rotary resistive potentiometer 98 having four input taps 100, 102, 104, and 106 to which are applied, respectively, the main output signal, and the phase shifted signal. The output signal of combining circuit 16 is provided on an output 108 taken from a fixed terminal 110 of a wiper contact 112. Wiper contact 112 is movable to make contact with any of the input taps or the potentiometer resistor to intermediate any two of the input taps. With the wiper contact 112 in the position as shown in FIG. 1, the signal produced on output 108 comprises a mixture of the main output signal and the phase shifted signal. An output signal comprising a mixture of the auxiliary output signal and the phase shifted signal, a mixture of the auxiliary output signal and the audio input signal and a mixture of the main output signal and the audio input signal may likewise by achieved by moving the wiper contact 112 to positions between inputs taps 106 and 102, 102 and 104, and 104 and 100, respectively. An amplifier and speaker 114 is coupled with output 108 to amplify and convert the mixed output signal into corresponding sounds.

While a particular embodiment has been shown and described in detail, it should be appreciated that numerous changes may be made thereto without departing from the concepts of the invention embodied therein. For example, while the modulation rate is shown in FIG. 1 as being controlled in accordance with the level of a DC signal, other types of control signals and oscillators could be successfully employed together to serve the same function as voltage controlled oscillator 62 and the manually operable controlling circuit 64. Further, it should be clear that many additional operator controls could be added to the embodiment shown in FIG. 1 to establish the maximum and minimum levels of modulation and modulation rate and also, for instance, to selectively vary the preselected time periods for charging and discharging capacitor 80. Likewise, while each of the outputs is shown connected directly to a speaker, it should be understood that suitable amplifiers may be interposed between each output and its associated speaker and appropriate switches or connectors may be provided to selectively couple or uncouple the outputs with their associated speakers, as desired.

We claim:

1. In a special sound effects circuit having a phase shifter for developing a signal shifted in phase with respect to an input signal, said phase shifter having a characteristic frequency at which phase shifting commences, means for combining the phase shifted and input signals, and means for periodically modulating the characteristic frequency, a modulation control circuit, comprising:

means for generating a control signal;

means responsive to the control signal for altering the rate of periodic modulation; and means responsive to the control signal for unidirectionally varying the characteristic frequency as the rate of periodic modulation is changed.

2. The sound effects circuit of claim 1 in which the modulation rate altering means is responsive to a change in the control signal for reducing the modulation rate by a preselected amount and the characteristic frequency varying means is responsive to the same change in the control signal for increasing the characteristic frequency by another preselected amount.

3. The sound effects circuit of claim 2 in which the control signal gradually changes from the first condition to a second condition during a preselected time period and said modulation rate reducing means gradually reduces the modulation rate by a factor on the order of 10 in response thereto during said preselected time period.

4. The sound effects circuit of claim 3 in which the preselected time period is on the order of 2 to 4 seconds.

5. The sound effects circuit of claim 4 in which the modulation rate is reduced from a frequency on the order of 10 hertz to a frequency on the order of 1/10 hertz.

6. The sound effects circuit of claim 2 in which the combining means has a frequency response curve characterized by alternate nulls and peaks and the preselected amount of increase in the characteristic frequency of the phase shifter results in increasing the frequency at which said nulls and peaks occur by an amount on the order of 2.5 octaves.

7. The sound effects circuit of claim 1 wherein said control signal is selectively varied by said modulation rate altering means, said selected variation increases the rate of periodic modulation by a preselected amount and said characteristic frequency varying means decreases the characteristic frequency in response to said selected variation of the control signal.

8. The sound effects circuit of claim 7 in which the modulation rate is increased by a factor on the order of 10.

9. The sound effects circuit of claim 8 in which the selected variation of the control signal is gradually achieved during said modulation rate increase.

10. The sound effects circuit of claim 9 in which said modulation rate is increased from a frequency on the order of 0.1 hertz to a frequency on the order of 10 kHz during said time period.

11. The sound effects circuit for claim 7 in which the combining means has a comb shaped frequency response curve characterized by alternate nulls and peaks, and the reduction in the characteristic frequency of the phase shifter results in reducing the frequency at which said nulls and peaks occur by a factor on the order of 2.5 octaves.

12. The sound effects circuit of claim 1 in which said control signal comprises a DC signal and said control signal generating means includes a switch and means responsive to actuation of the switch for gradually changing the magnitude of the control signal from a first level to a second level during a preselected time period.

13. The sound effects circuit of claim 12 in which said control signal generating means includes an RC time delay circuit and said preselected time period is established by the RC time constant thereof.

14. The sound effects circuit of claim 1 in which the characteristic frequency of the phase shifter changes in accordance with changes in a phase shift control signal applied to a control input thereof, said modulating means includes means for applying an alternating signal to said control input, said characteristic frequency periodically changing with periodic changes of said alternating signal, and said modulation rate varying means includes means for gradually changing the frequency of the alternating signal in accordance with gradual changes of the control signal.

15. The sound effects circuit of claim 14 in which
said alternating signal applying means comprises a voltage controlled oscillator and
said modulation rate altering means includes means for applying a DC control signal thereto, the frequency of the voltage controlled oscillator changing with the amplitude of the DC signal.

16. The sound effects circuit of claim 14 wherein the characteristic frequency varying means includes
means for developing a signal with an amplitude proportional to that of the DC control signal and
means for applying the proportional signal to the control input of the phase shifter, said proportional signal causing said phase shifter to assume an average characteristic frequency instantaneous characteristic frequency, the of the phase shifter periodically varying above and below the average characteristic frequency in accordance with amplitude changes of the alternating signal.

17. In an electrical musical instrument, a special sound effect circuit for modulating an input signal, comprising:
phase shifting means for producing a signal shifted in phase with respect to the input signal, said phase shifting means having a characteristic frequency below which an input signal will not be substantially phase shifted;
combining means coupled with both the input signal and the phase shifted signal for developing an output signal proportional to the arithmetic difference between the signals, said combining means and phase shifting means having a frequency response curve with respect to the input signal characterized by peak response levels at frequencies at which the phase shifted signal is out of phase from the input signal by an odd integer multiple of 180°; and
means for modulating the characteristic frequency of said phase shifting means whereby the frequency response of said combining means is modulated.

18. The sound effects of claim 17 in which the combining means comprises a differential amplifier.

19. The sound effects circuit of claim 17 including means for varying the rate of modulation and means for automatically varying the characteristic frequency in a sense opposite to that of the rate variation, said variation in the characteristic frequency resulting in varying the frequency of the lowest frequency peak response point of the frequency response curve.

20. The sound effects circuit of claim 17 including means for mixing the output signal with the phase shifted signal in selectively variable proportions to develop another output signal.

21. The sound effects circuit of claim 20 including means for mixing the input signal with the output signal.

22. The sound effects circuit of claim 17 including means for mixing output signal with the input signal to develop another output signal.

23. A special sound effects circuit comprising:
a phase shifter for producing a signal shifted in phase with respect to an input signal upon the input signal achieving a characteristic frequency of the phase shifter;
means for modulating the characteristic frequency;
summing means for developing a first output signal proportional to the sum of the input signal and the phase shifted signal, said summing means having a comb shaped frequency response curve;
difference means for developing a second output signal proportional to the arithmetic difference between the input and phase shifted signals, said difference means having a comb shaped frequency response curve inversely related to the response curve of the summing means;
means for applying the first output signal to a transducer to develop corresponding sounds in accordance therwith; and
means for applying the second output signal to another transducer to develop corresponding sounds in accordance therewith.

24. The sound effects circuit of claim 23 including means for selectively mixing the input signal with the first and second output signals.

25. The sound effects circuit of claim 24 in which said mixing means includes means for selectively mixing the phase shifted signal with the first and second output signals.

26. The sound effects circuit of claim 25 wherein said mixing means includes a potentiometer with four input taps located along a potentiometer element thereof for respectively receiving the first and second output signals, the input signal and the phase shifted signal, and an output tap selectably connectable to any point along said potentiometer element.

27. The sound effects circuit of claim 26 in which said output tap is a wiper contact selectively movable to different positions along the potentiometer element.

28. The sound effects circuit of claim 25 in which said mixing means includes means for selectively varying the proportion of the signals which are mixed together.

29. The sound effects circuit of claim 23 in which the difference means comprises a differential amplifier.

30. The sound effects circuit of claim 23 including means for reducing the rate of modulation, and means for selectively increasing the characteristic frequency as the rate of modulation is decreased, said increase in the characteristic frequency resulting in increasing the frequency of the lowest frequency peak response point of the frequency response curve of the difference means.

* * * * *